US008953969B2

(12) United States Patent
Hattori

(10) Patent No.: US 8,953,969 B2
(45) Date of Patent: Feb. 10, 2015

(54) IMAGE FORMING APPARATUS HAVING SUCTION DUCT FOR SUCKING DEVELOPER NOT USED IN DEVELOPMENT

(71) Applicant: Fuji Xerox Co., Ltd., Minato-ku, Tokyo (JP)

(72) Inventor: Ryuji Hattori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 65 days.

(21) Appl. No.: 13/705,725

(22) Filed: Dec. 5, 2012

(65) Prior Publication Data

US 2013/0279946 A1 Oct. 24, 2013

(30) Foreign Application Priority Data

Apr. 19, 2012 (JP) ..... 2012-096003

(51) Int. Cl.
*G03G 15/095* (2006.01)
*G03G 15/09* (2006.01)
*G03G 15/08* (2006.01)

(52) U.S. Cl.
CPC ..... *G03G 15/0921* (2013.01); *G03G 15/0815* (2013.01); *G03G 15/0942* (2013.01); *G03G 2215/0648* (2013.01)
USPC ..... 399/99; 399/264; 399/277

(58) Field of Classification Search
CPC . G03G 15/09; G03G 15/0898; G03G 15/095; G03G 15/399
USPC ..... 399/277, 99
See application file for complete search history.

(56) References Cited

U.S. PATENT DOCUMENTS

| | | | | |
|---|---|---|---|---|
| 4,947,200 | A * | 8/1990 | Kumasaka et al. | 399/231 |
| 7,043,172 | B2 * | 5/2006 | Koshimura et al. | 399/99 |
| 2006/0051137 | A1 * | 3/2006 | Murata et al. | 399/277 |
| 2008/0080906 | A1 * | 4/2008 | Kawahara et al. | 399/277 |
| 2009/0232543 | A1 * | 9/2009 | Urasawa et al. | 399/113 |
| 2010/0150616 | A1 * | 6/2010 | Fujimori et al. | 399/279 |

FOREIGN PATENT DOCUMENTS

| | | | | |
|---|---|---|---|---|
| JP | 04-355481 | A | 12/1992 | |
| JP | 2000039768 | A * | 2/2000 | G03G 15/08 |

* cited by examiner

*Primary Examiner* — Walter L Lindsay, Jr.
*Assistant Examiner* — Arlene Heredia Ocasio
(74) *Attorney, Agent, or Firm* — Sughrue Mion, PLLC

(57) ABSTRACT

An image forming apparatus includes an image carrier, a developing unit, and a developer sucking section. A relationship $0 \leq X \leq R + kRW$ (where k=10 to 12) is established, when X (m) is a distance from a center of a transport pole to a position where a straight line crosses a rotating section, R (m) is a chain standing length of developer on the transport pole, W (m/s) is a peripheral velocity of the developing unit, and k is a coefficient. The transport pole is adjacent to a development pole and is situated downstream of the development pole in a direction of rotation of the rotating section. The straight line is situated at a downstream side in the direction of rotation of the rotating section and connects a center of rotation of the developing unit and an end of the developer sucking section.

2 Claims, 6 Drawing Sheets

IMAGE FORMING APPARATUS HAVING SUCTION DUCT FOR SUCKING DEVELOPER NOT USED IN DEVELOPMENT

CROSS-REFERENCE TO RELATED APPLICATIONS

This application is based on and claims priority under 35 USC 119 from Japanese Patent Application No. 2012-096003 filed Apr. 19, 2012.

BACKGROUND (i) Technical Field

The present invention relates to an image forming apparatus.

(ii) Related Art

In electrophotographic image forming apparatuses, a two-component developer (in which toner and magnetic carriers are mixed) or a magnetic one-component developer (in which magnetic toner is the principal component) is often used. The developer is transported to a developing roller (an exemplary developing unit) by a transporting member from a developer containing section of a developing device, and is then transported to a position (a development nip where a development pole of the developing roller is positioned) opposing a photoconductor drum (an exemplary image carrier) while being magnetically attracted to a peripheral surface of the developing roller. Then, the developer is transferred to the photoconductor drum, so that an electrostatic latent image that is formed on the photoconductor drum is developed.

In image forming apparatuses having such a structure, when the developing roller is one that rotates in a direction opposite to the direction of rotation of the photoconductor drum at a portion of the developing roller opposing the photoconductor drum, a suction duct (an exemplary developer sucking section) that is open above the developing roller is provided, so that developer (cloud toner) that is scattered without being supplied for development is sucked using negative pressure.

Therefore, when the sucked cloud toner passes the suction duct, a portion of the cloud toner adheres to/accumulates on an inner wall of the duct. When the suction duct is oriented downward, the accumulated toner sporadically drops onto the developing roller. When the developing roller rotates in the direction that is mentioned above, a transport pole of the developing roller causes the dropped toner to be transported into the developing device and to be collected.

Here, as the amount of cloud toner that is generated is increased, the amount of toner that drops at the same time is increased, as a result of which the toner transport capability of the developing roller is exceeded. Therefore, the toner reaches and passes the development nip. The toner that has passed the development nip is thinly scattered in the vicinity of the toner that has been transferred to the photoconductor drum. The thinly scattered toner causes a partial increase in toner density, and reduces image quality.

In order to prevent such a phenomenon, it is necessary to increase the toner transport/collecting capability of the developing roller so that the dropped toner does not reach the development nip. In order to achieve this, the toner drop position may be situated further downstream of the transport pole. However, when an end of the suction duct is moved away from the transport pole by using such a structure, the cloud toner that is generated at the transport pole is also sucked by the suction duct.

SUMMARY

According to an aspect of the invention, there is provided an image forming apparatus including an image carrier on which an electrostatic latent image is formed; a developing unit including magnetic poles and a rotating section, the magnetic poles including a development pole and a transport pole disposed along a peripheral direction, the rotating section being rotatably disposed at outer peripheries of the magnetic poles, the developing unit being disposed so as to oppose the image carrier, the developing unit performing, at the development pole, development by supplying developer to the electrostatic latent image on the image carrier with a portion of the rotating section that opposes the image carrier rotating in a direction opposite to a direction of rotation of the image carrier; and a developer sucking section that opens above the developing unit and that sucks developer that is not used in the development. In the image forming apparatus, a relationship $0 \leq X \leq R+kRW$ (where k=10 to 12) is established, when X (m) is a distance from a center of the transport pole to a position where a straight line crosses the rotating section, R (m) is a chain standing length of the developer on the transport pole, W (m/s) is a peripheral velocity of the developing unit, and k is a coefficient. The transport pole is adjacent to the development pole and is situated downstream of the development pole in the direction of rotation of the rotating section. The straight line is situated at a downstream side in the direction of rotation of the rotating section and connects a center of rotation of the developing unit and an end of the developer sucking section.

BRIEF DESCRIPTION OF THE DRAWINGS

An exemplary embodiment of the present invention will be described in detail based on the following figures, wherein.

DETAILED DESCRIPTION

Figure 1:
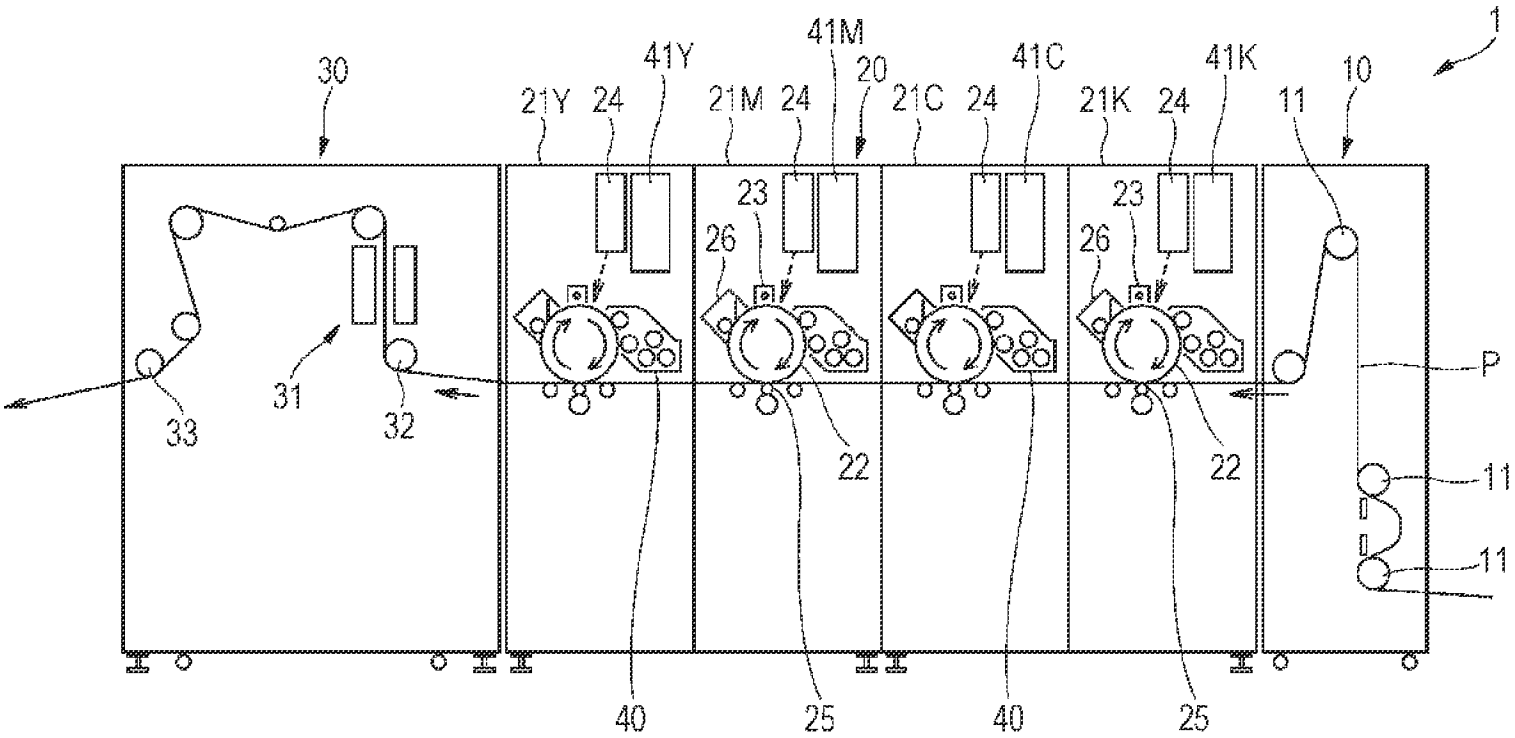
FIG. 1 is a conceptual diagram of an image forming apparatus according to an exemplary embodiment of the present invention.

An exemplary embodiment of the present invention will hereunder be described in detail with reference to the drawings. In the drawings for illustrating the exemplary embodiment, corresponding structural elements are generally given the same reference numerals, and the same descriptions will not be repeated.

FIG. 1 is a conceptual diagram of an exemplary image forming apparatus 1 according to an exemplary embodiment of the present invention.

The image forming apparatus 1 is a large apparatus that forms at a high speed an image on continuous paper (an exemplary transfer medium) P that is a transfer material. The image forming apparatus 1 includes a sheet transporting section 10 that transports and supplies the continuous paper P, an image forming section 20 that forms an image and transfers the image to the continuous paper P, and a fixing section 30 that fixes the transferred image.

The sheet transporting section 10 includes winding rollers 11 that transport the continuous paper P when the continuous paper P is wound upon the winding rollers 11. The winding rollers 11 transport the continuous paper P to the image forming section 20 while applying tension to the continuous paper P.

The image forming section 20 includes four image forming units 21K, 21C, 21M, and 21Y disposed in that order from an upstream side along a transport path of the continuous paper P. The image forming units 21K, 21C, 21M, and 21Y form toner images by transferring black (K), cyan (C), magenta (M), and yellow (Y) toners.

The image forming units 21K, 21C, 21M, and 21Y each include a photoconductor drum (an exemplary image carrier) 22. In each photoconductor drum 22, an optical conductive layer is formed on an outer peripheral surface of a cylindrical member formed of a conductive material. A charging device 23 that charges the surface of the associated photoconductor drum 22, an exposure device 24 that forms an electrostatic latent image on the surface of the associated charged photoconductor drum 22 by irradiating the associated charged photoconductor drum 22 with image light, a developing device 40 that forms a toner image by transferring toner to the electrostatic latent image on the associated photoconductor drum 22, a transferring roller (an exemplary transferring unit) that transfers the toner image formed on the associated photoconductor drum 22 to the continuous paper P, and a cleaning device 26 that removes residual toner on the photoconductor drum 22 after the transfer are provided in the vicinity of the associated photoconductor drum 22.

The four image forming units 21K, 21C, 21M, and 21Y have the same structure except that their developing devices 40 contain toners of different colors. Toner replenishment containers 41K, 41C, 41M, and 41Y that replenish the respective developing devices 40 with toners of colors corresponding to those of the toners contained in the associated developing devices 40 are provided above the associated developing devices 40. They are replenished with toners to be consumed by development.

The fixing section 30 that is provided downstream of the image forming section 20 is provided with a flash fixing device 31 that fixes unfixed toner images transferred to the continuous paper P at the image forming section 20. The continuous paper P to which the toner images are transferred is wound upon a transport roller 32 to guide the continuous paper P to the flash fixing device 31. The flash fixing device 31 heats the toner by radiation heat from a heating source, and fixes the toner images to the continuous paper P. The continuous paper P to which the toner images are fixed is wound upon a discharge roller 33, and discharged outside the image forming apparatus 1.

Figure 2:
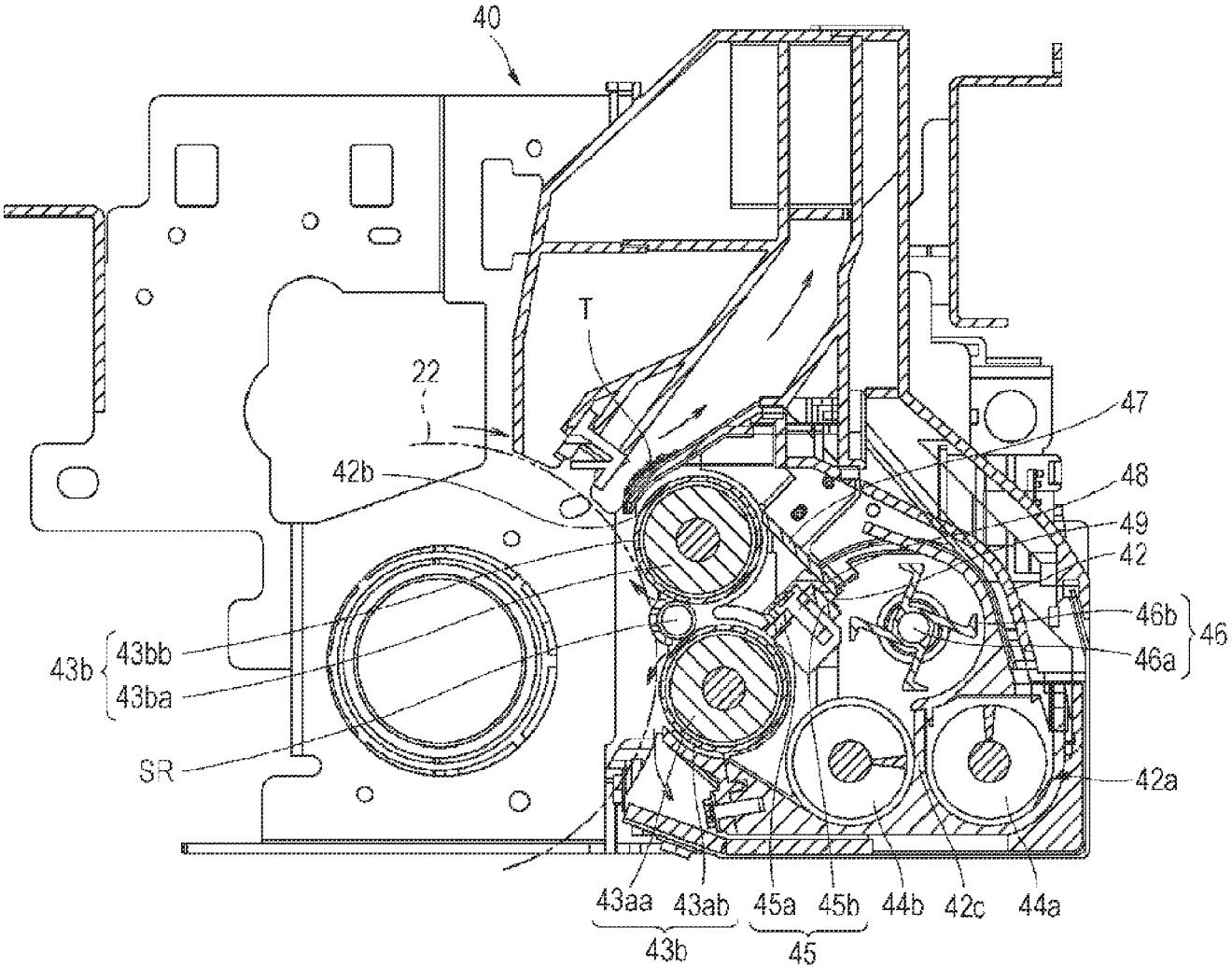
FIG. 2 is a sectional view of a developing device of the image forming apparatus shown in FIG. 1 and the vicinity thereof.

FIG. 2 is a sectional view of a developing device 40 of the image forming apparatus 1 shown in FIG. 1 and the vicinity thereof.

The developing device 40 includes a housing (an exemplary device housing) 42 that functions as a supporting frame. The housing 42 includes a developer containing section 42*a* and an opening 42*b*. The developer containing section 42*a* contains, for example, two-component developer including toner and magnetic carriers. The opening 42*b* is formed at a position opposing the photoconductor drum 22.

Two developing rollers (exemplary developing units) 43*a* and 43*b*, two transporting members (exemplary transporting units) 44*a* and 44*b*, a layer thickness regulating member (an exemplary layer thickness regulating unit) 45, a rotating transporting member 46, and a transporting guide 47 are provided in the interior of the housing 42 while they are in a supported state.

The developing rollers 43*a* and 43*b* are members that develop an image on the surface of the photoconductor drum 22 using developer. The developing rollers 43*a* and 43*b* are disposed side by side in a vertical direction while a portion of the outer peripheral surface of each of the developing rollers 43*a* and 43*b* is exposed at the opening 42*b*. The developing rollers 43*a* and 43*b* are disposed side by side so that the directions of rotary shafts (directions perpendicular to the plane of FIG. 2) are parallel to the direction of a rotary shaft of the photoconductor drum 22 (direction perpendicular to the plane of FIG. 2).

The outer peripheral surface of each of the developing rollers 43*a* and 43*b* oppose the outer peripheral surface of the photoconductor drum 22 with a gap therebetween. Toner is supplied to the photoconductor drum 22 from a portion of each of the developing rollers 43*a* and 43*b* opposing the photoconductor drum 22 (that is, a development nip, a development pole).

The outer peripheral surface of the upper developing roller 43*b* and the outer peripheral surface of the lower developing roller 43*a* oppose each other with a gap therebetween. At opposing portions of the outer peripheral surfaces of the developing rollers 43*a* and 43*b*, developer is transferred from the lower developing roller 43*a* to the upper developing roller 43*b*.

The developing roller 43*a* includes a magnet roller 43*aa* and a cylindrical sleeve 43*ab* (an exemplary rotating section) disposed along the outer periphery of the magnet roller 43*aa*. The developing roller 43*b* includes a magnet roller 43*ba* and a cylindrical sleeve 43*bb* (an exemplary rotating section) disposed along the outer peripheral of the magnet roller 43*ba*. The magnet rollers 43*aa* and 43*ba* are secured and supported by the housing 42. The sleeves 43*ab* and 43*bb* are rotatably supported along the outer peripheral surfaces of the associated magnet rollers 43*aa* and 43*ba*.

Each of the magnet rollers 43*aa* and 43*ba* include magnetic poles that are magnetized along a peripheral direction. This causes the developer to be magnetically attracted to the outer peripheral surfaces of the sleeves 43*ab* and 43*bb*.

Figure 6:
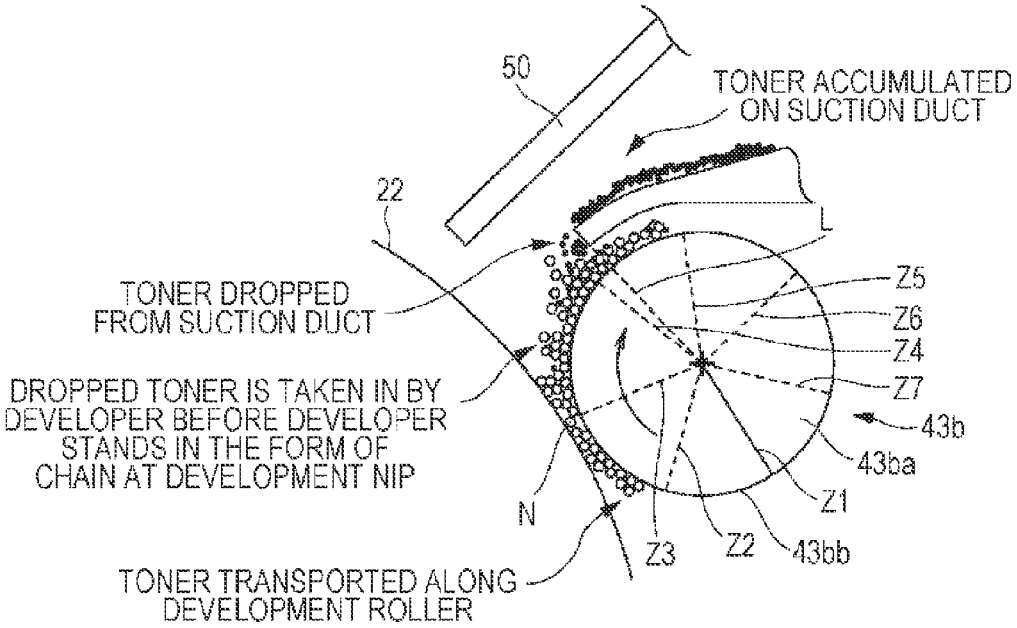
FIG. 6 illustrates the behavior of dropped toner when a straight line connecting the center of rotation of the developing roller and the end of the suction duct is positioned downstream of the center of the transport pole.

For example, magnetic poles Z1 to Z7 (exemplary magnetic poles) that constitute the magnet roller 43*ba* are such that the attraction pole Z1 attracts the developer, the transport poles Z2, Z4, Z5, and Z7 transport the developer to an adjacent pole, the development pole Z3 supplies toner to the surface of the photoconductor drum 22, and the separating pole Z6 separates the developer (see FIG. 6). The polarities of the magnetic poles Z1 to Z6 are such that the attraction pole Z1 is an S pole, the transport pole Z2 is an N pole, the development pole Z3 is an S pole, the transport pole Z4 is an N pole, the transport pole Z5 is an S pole, the separating pole Z6 is an S pole, and the transport pole Z7 is an N pole.

These causes the developer to be transferred between the two developing rollers 43*a* and 43*b*, and the toner to be supplied to the photoconductor drum 22. Each of the magnetic poles is magnetized in the directions of the rotary shafts of the magnetic rollers 43*aa* and 43*ba*, and magnetic fields are formed in the vicinity of either of the positions thereof in the directions of the rotary shafts thereof. The sleeves 43*ab* and 43*bb* are formed of, for example, nonmagnetic materials, such as aluminum, brass, stainless steel, or conductive resin. A portion of the sleeve 43*ab* of the lower developing roller 43*a* opposing the photoconductor drum 22 rotates in the same direction as the photoconductor drum 22 rotates. A portion of the sleeve 43*bb* of the upper developing roller 43*b* opposing the photoconductor drum 22 rotates in a direction opposite to the direction of rotation of the photoconductor drum 22.

The lower developing roller 43*a* is the last developing roller that supplies toner to the photoconductor drum 22. Therefore, the amount of toner that is supplied to the photoconductor drum 22 is adjusted so as to form a good image.

A sealing roller SR is provided between the upper developing roller 43*b* and the lower developing roller 43*a* at the opening 42*b* of the housing 42. The sealing roller SR is disposed so that the direction of its rotary shaft (direction perpendicular to the plane of FIG. 2) is parallel to the developing rollers 43*a* and 43*b*. The sealing roller SR is a sealing member that prevents the toner in the developing device 40 from leaking to the outside from a location between the developing rollers 43*a* and 43*b*.

The transporting members 44*a* and 44*b* are members that transport the two-component developer to the developing rollers 43*a* and 43*b* while stirring and mixing the two-component developer. The transporting members 44*a* and 44*b* are rotatably disposed in respective right and left areas with a partition wall 42*c* being disposed therebetween in the developer containing section 42*a* disposed below the lower developing roller 43*a*. The transporting members 44*a* and 44*b* are disposed side by side so that the directions of rotary shafts thereof (directions perpendicular to the plane of FIG. 2) are parallel to the directions of the rotary shafts of the developing rollers 43*a* and 43*b*.

For example, spiral rotary blades are formed at the outer peripheries of the rotary shafts of the transporting members 44*a* and 44*b*. The two-component developer in the areas of the developer containing section 42*a* are transported in the directions of the rotary shafts of the transporting members 44*a* and 44*b* and in opposite directions. Openings (not shown) are provided in respective ends of the partition wall 42*c* in the directions of the rotary shafts of the transporting members 44*a* and 44*b*. The developer in the areas that are partitioned by the partition wall 42*c* is transferred and circulated through the openings.

Of the two transporting members 44*a* and 44*b*, in FIG. 2, the left transporting member 44*b* disposed downstream in the direction of transport is disposed while opposing the lower developing roller 43*a* and while being separated from the lower developing roller 43*a* by a gap. The two-component developer is transferred to the lower developing roller 43*a* from the transporting member 44*b* at a portion where the transporting member 44*b* and the developing roller 43*a* oppose each other. The two-component developer is supplied into the developer containing section 42*a* through a developer supply opening (not shown) formed in an end portion of the developer containing section 42*a*.

The aforementioned layer thickness regulating member 45 is a plate member that regulates a layer thickness of the two-component developer that is transported from the transporting members 44*a* and 44*b* to the developing rollers 43*a* and 43*b*. The two-component developer transferred from the transporting member 44*b* (disposed downstream in the direction of transport) to the lower developing roller 43*a* is transported to the portions of the respective developing rollers 43*a* and 43*b* that oppose the photoconductor drum 22 (the development nips, the development poles) after regulating the layer thickness of the developer (the amount of developer) by the layer thickness regulating member 45.

The layer thickness regulating member 45 is formed of a plate member having a front end portion 45*a* and a rear end portion 45*b*. The front end portion 45*a* is rectangular in cross section. The rear end portion 45*b* is formed continuously with the front end portion 45*a* and is rectangular in cross section. The layer thickness regulating member 45 is removably secured by a bolt 48 directly above the transporting member 44*b* (disposed downstream in the direction of transport) and obliquely above the lower developing roller 43*a*. The layer thickness regulating member 45 is disposed beside the lower developing roller 43*b* so that its longitudinal direction (direction perpendicular to the plane of FIG. 2) is parallel to the direction of the rotary shaft of the lower developing roller 43*b*.

The front end portion 45*a* of the layer thickness regulating member 45 is disposed while opposing the outer periphery of the lower developing roller 43*a* and while being separated from the outer periphery of the lower developing roller 43*a* by a gap that is in accordance with a prescribed layer thickness value of the developer. While the two-component developer is frictionally charged by mutual magnetic action between the front end portion 45*a* of the layer thickness regulating member 45 and the magnet roller 43*aa* of the lower developing roller 43*a*, the thickness of the layer of the two-component developer is reduced and the two-component developer whose layer thickness has been reduced is held by the surface of the sleeve 43*ab* of the lower developing roller 43*a*.

The rear end portion 45*b* of the layer thickness regulating member 45 is formed so as to bend in a direction that crosses the front end portion 45*a*, and is connected to a portion of the transporting guide 47 (situated directly above the layer thickness regulating member 45) by a thermally conductive joining member 49. The rear end portion 45*b* facilitates positioning of the layer thickness regulating member 45 in the housing 42, and enhances heat dissipation by increasing contact area with the joining member 49.

The rotating transporting member 46 is a member that returns any residual developer remaining on the upper developing roller 43*b* to the interior of the developer containing section 42*a*, and is set directly above a location between the transporting members 44*a* and 44*b* and next to (on the right in FIG. 2 of) the layer thickness regulating member 45 so as to be rotatable clockwise. The rotating transporting member 46 is disposed so that the direction of a rotary shaft thereof (direction perpendicular to the plane of FIG. 2) is parallel to the directions of the rotary shafts of the developing rollers 43*a* and 43*b* and the directions of the rotary shafts of the transporting members 44*a* and 44*b*.

Four rotary blades 46*b* are formed at the outer periphery of the rotary shaft 46*a* of the rotating transporting member 46. Each rotary blade 46*b* is bent in an L shape in cross section so that the transported developer is held. This is to, without increasing the size of the developing device 40, increase the developer holding capacity by rotating the rotating transporting member 46 at a low speed and collecting the developer in the rotating transporting member 46.

The aforementioned transporting guide 47 is a member for forming a path for transporting the residual developer on the upper developing roller 43*b* and returning the developer into the developer containing section 42*a*. The transporting guide 47 is formed using a thermal conductive material, such as stainless steel, aluminum, or copper, as a principal material.

The transporting guide 47 is set so as to be tilted downward towards the rotating transporting member 46 from the upper developing roller 43*b* at a location between the upper developing roller 43*b* and the rotating transporting member 46 and directly above the layer thickness regulating member 45. The transporting guide 47 is disposed so that its longitudinal direction (direction perpendicular to the plane of FIG. 2) is parallel to the direction of the rotary shaft of the developing roller 43*b* and the direction of a rotary shaft of the rotating transporting member 46. Any residual developer on the upper developing roller 43*b* after development is transferred to the transporting guide 47 by a repulsive force at the separation pole Z4 of the magnet roller 43*ba* and the rotational centrifugal force of the developing roller 43*b*. Thereafter, the residual developer slides as it is along a tilted surface of the transporting guide 47 and is transported to the rotating transporting member 46.

The layer thickness regulating member 45 is disposed next to and directly below the transporting guide 47. As mentioned above, the rear end portion 45*b* of the layer thickness regulating member 45 is connected to the transporting guide 47 by the joining member 49. The heat of the layer thickness regulating member 45 disposed at substantially the center of an inner side of the developing device 40, providing the lowest heat dissipation, and becoming the hottest flows to the transporting guide 47 through the joining member 49.

In the exemplary embodiment, as shown in FIG. 2, a suction duct 50 (an exemplary developer sucking section) that opens above the developing roller 43*b* and that sucks cloud toner that is developer being scattered without being used in the development is provided.

The suction duct 50 is an upper duct that, using negative pressure, sucks cloud toner, generated from the developing rollers 43*a* and 43*b* in the opening 42*b* of the housing 42, by a suction fan (not shown). Air current at the suction duct 50 flows towards the upper side of the image forming apparatus 1 from the opening 42*b* as indicated by arrows. The cloud toner sucked at the opening 42*b* is trapped by a filter (not shown), which is disposed along the way, and only clean air is discharged to the outside of the image forming apparatus 1.

The relationship between the developing roller 43*b* and the suction duct 50 will be described later.

Such a developing device 40 operates, for example, as follows.

The two-component developer contained in the developer containing section 42*a* of the housing 42 is stirred and mixed by the transporting members 44*a* and 44*b*, and is supplied to the surface of the lower developing roller 43*a*. The two-component developer attracted to the sleeve 43*ab* of the lower developing roller 43*a* by an attraction pole (which is a magnetic pole provided at the magnet roller 43*aa* of the lower developing roller 43*a*) is transported to the layer thickness regulating member 45 by the rotation of the sleeve 43*ab*. Then, while this two-component developer is frictionally charged by mutual magnetic action between the layer thickness regulating member 45 and the magnet roller 43*aa* of the developing roller 43*a*, the thickness of the layer of the two-component developer (the amount of developer) is regulated and is held by the surface of the sleeve 43*ab*.

The developer that has passed the layer thickness regulating member 45 has its layer thickness reduced and is held by and transported on the sleeve 43*ab* of the lower developing roller 43*a*, and is substantially divided in two at a position of the lower developing roller 43*a* opposing the upper developing roller 43*b*. One of the portions is transferred to the upper developing roller 43*b* by the action of a magnetic pole, and the other portion is held by and transported on the sleeve 43*ab* of the lower developing roller 43*a*.

The developer held by the sleeve 43*ab* of the lower developing roller 43*a* is transported to a portion where the sleeve 43*ab* opposes the photoconductor drum 22 (the development nip, the development pole), and developer toner is transferred to an electrostatic latent image on the photoconductor drum 22 by a development bias voltage applied to a location between the lower developing roller 43*a* and the photoconductor drum 22.

The developer held by the sleeve 43*bb* of the upper developing roller 43*b* is transported to a portion where the sleeve 43*bb* opposes the photoconductor drum 22 (the development nip N, the development pole Z3) by the rotation of the sleeve 43*bb*, and developer toner is transferred to the electrostatic latent image on the photoconductor drum 22 by a development bias voltage applied to a location between the upper developing roller 43*b* and the photoconductor drum 22.

Any residual developer that has passed the portion of the sleeve 43*bb* of the upper developing roller 43*b* opposing the photoconductor drum 22 is separated by the action of the separating pole Z6 of the magnet roller 43*ba* of the upper developing roller 43*b* and the centrifugal force of the sleeve 43*bb* of the developing roller 43*bb*, and is transferred to the transporting guide 47.

The developer after the development transferred to the transporting guide 47 slides along the tilted surface of the transporting guide 47, and is transported to the rotating transporting member 46. The developer transferred to the transporting guide 47 is not returned directly to the developer containing section 42*a*. It is instead returned to the developer containing section 42*a* (where the developer is subjected to stirring and mixing of the transporting members 44*a* and 44*b* by the rotations of the transporting members 44*a* and 44*b*) while being temporarily held by the rotating transporting member 46. Thereafter, the same operations as those above are repeated.

Here, as mentioned above, when sucked cloud toner passes the suction duct 50, a portion thereof adheres to and accumulates on the inner wall of the duct. In FIG. 2, such toner is indicated by reference character T. When the suction duct 50 is oriented downward, the accumulated toner T sporadically drops onto the developing roller 43*b*. The toner T that has dropped onto the developing roller 43*b* is returned to the developing containing section 42*a* in the developing device 40 by the transport poles Z4 and Z5 of the developing roller 43*b*.

However, as the amount of the toner T that accumulates on the suction duct 50 is increased, the amount of the toner T that drops at the same time is consequentially increased, as a result of which the toner transport capability of the developing roller 43*b* is exceeded. Therefore, the dropped toner T passes the development nip N. The toner T that has passed the development nip N is thinly scattered in the vicinity of the toner that has been transferred to the photoconductor drum 22. The thinly scattered toner causes a partial increase in toner density.

To avoid such a phenomenon, when an end of the suction duct 50 is retreated to move the toner drop position further downstream of the transport pole Z4, cloud toner that is generated at the transport pole Z4 is increased. That is, when the toner moves from the development pole Z3 (S pole) to the transport pole Z4 (N pole) and the transport pole Z5 (S pole) by the rotation of the sleeve 43*bb*, the chain standing length (the length of the toner that stands outwardly in a radial direction of the developing roller 43*b*) at the center of each of the poles Z3 to Z4 becomes the longest, as a result of which the toner standing in the form of a chain falls when it moves to the next magnetic pole having a different polarity. Since the cloud toner is generated when the toner standing in the form of a chain falls, when the end of the suction duct 50 is retreated, the cloud toner that is sucked by the suction duct 50 is increased.

The results of various repeated investigations show that, if the relationship between the developing roller 43*b* and the suction duct 50 is as follows, toner is sucked by the suction duct 50 while scattering of the toner at the transport pole Z4 is reduced.

That is, it is found that it favorable for the relationship to be $0 \leq X = R + kRW$ (where k=10 to 12), when X (m) is the distance from a center Z4-1 of the transport pole Z4 (that is, the transport pole that is adjacent to the development pole Z3 and that is situated downstream of the development pole Z3 in the direction of rotation of the sleeve 43*bb*) to a position where a straight line (L) (situated at a downstream side in the direction of rotation of the sleeve 43*bb* and connecting the center of rotation of the developing roller 43*b* and an end of the suction duct 50) crosses the sleeve 43*bb*; R (m) is a chain standing length of the toner T on the transport pole Z4; W (m/s) is the peripheral velocity of the developing roller 43*b*; and k is a coefficient.

This focuses on the point that cloud toner is generated when the toner T standing in the form of a chain falls.

Figure 4:
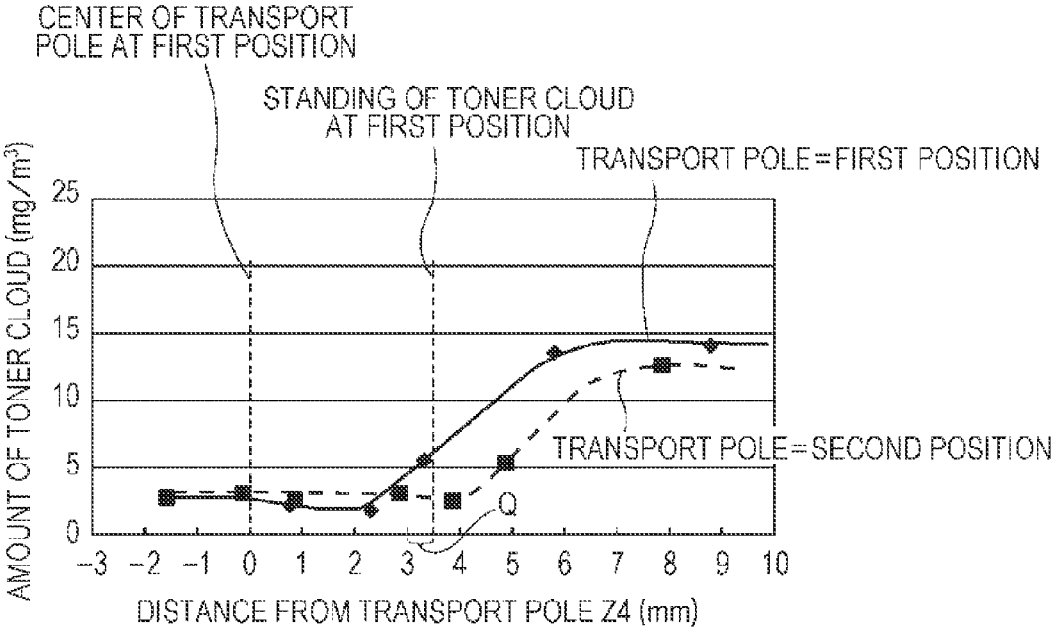
FIG. 4 is a graph showing the relationship between the amount of toner cloud and the distance from a transport pole of the developing roller.

The relationship between the distance from the transport pole Z4 and the amount of toner cloud is shown in FIG. 4. Here, the amounts of toner cloud generated in an image forming operation when the temperature is 28° C., the humidity is 85%, and the image density is 7.5% are observed when the transport pole is a first position and when the position is moved downstream by 20 degrees from the first position. As shown in FIG. 4, it is understood that, at the first position, the toner cloud stands when the distance is 3.5 mm from the center Z4-1 of the transport pole Z4; and, at the second position, substantially the same results are obtained.

Figure 3:
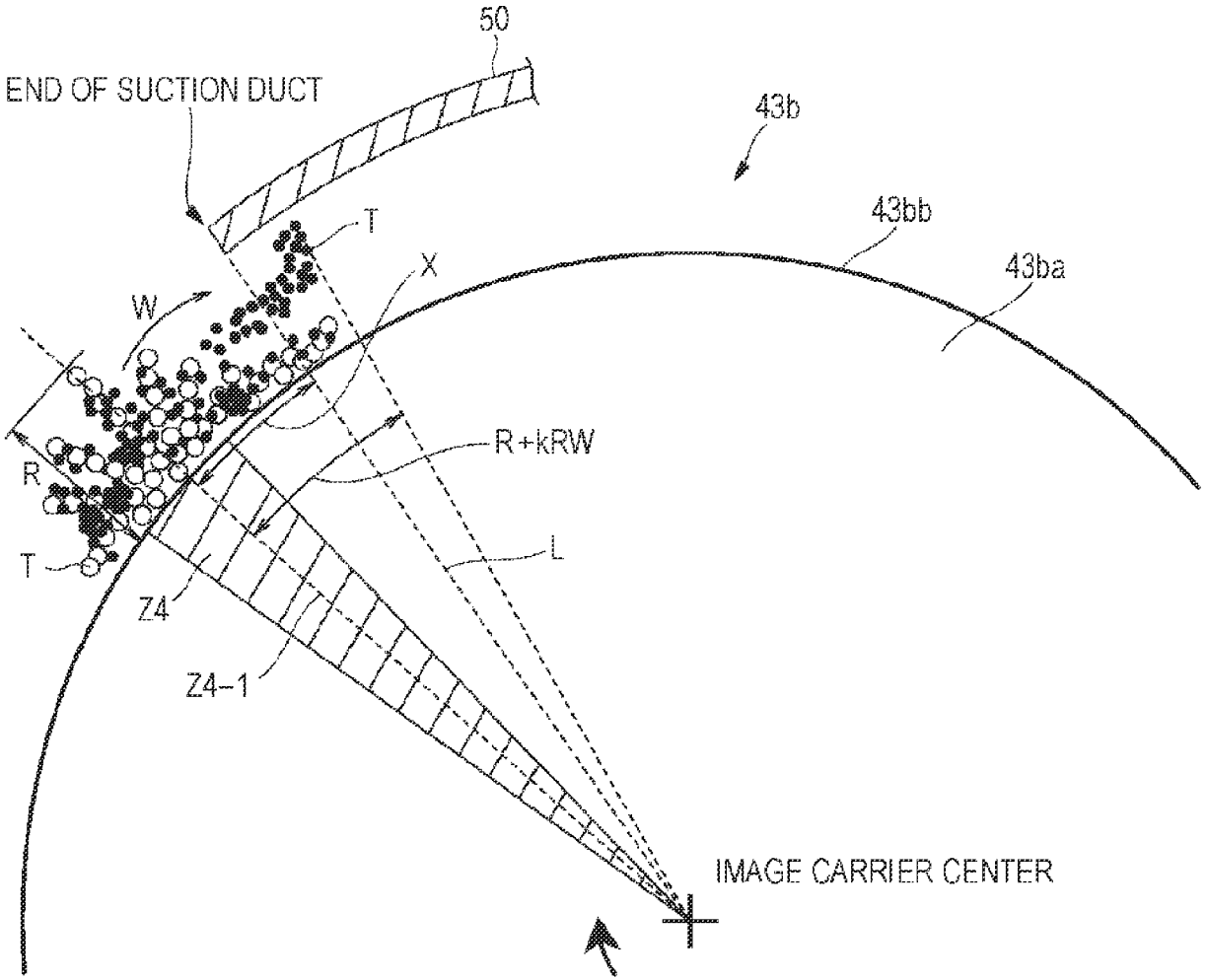
FIG. 3 illustrates the relationship between a suction duct and a developing roller at the image forming apparatus according to the exemplary embodiment of the present invention.
Figure 7:
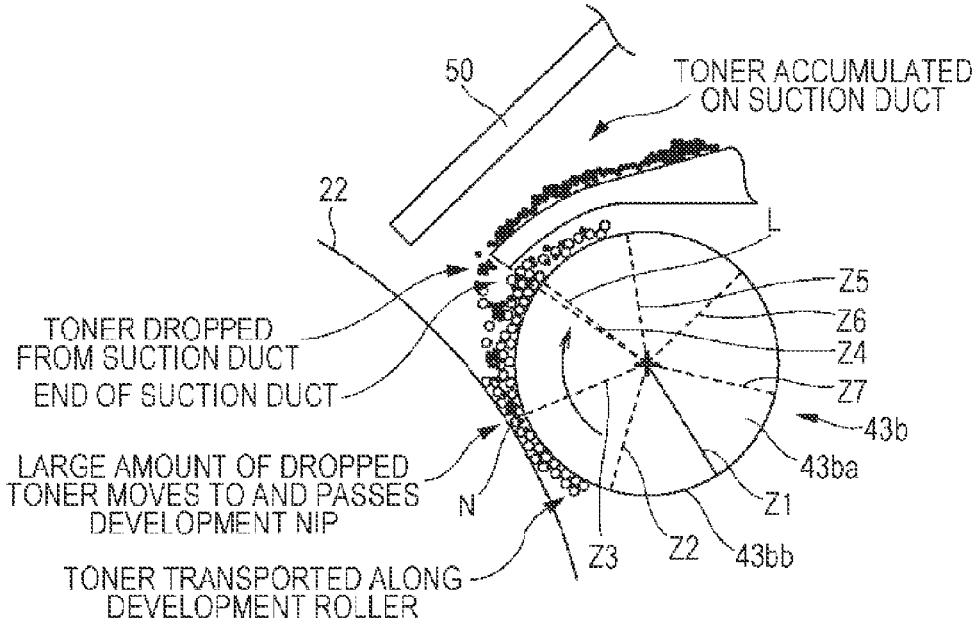
FIG. 7 illustrates the behavior of dropped toner when the straight line connecting the center of rotation of the developing roller and the end of the suction duct is positioned upstream from the center of the transport pole.

In FIG. 3 and FIGS. 6 and 7 (mentioned below), toner that is transported along the developing roller 43*b* is indicated by empty circles, whereas toner accumulated on the suction duct 50 and toner that has dropped from the suction duct 50 are indicated by solid circles.

Figure 5:
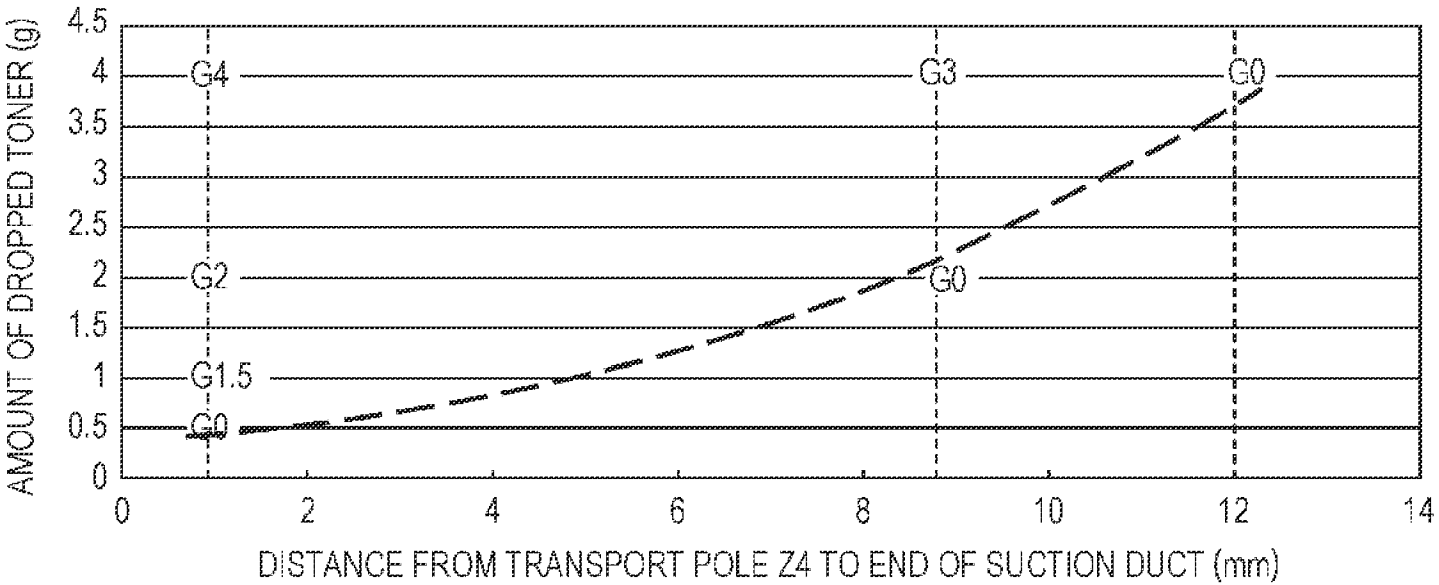
FIG. 5 is a graph showing the relationship in which the distance from the transport pole of the developing roller to an end of the suction duct and the amount of dropped toner influence image quality defect.

The relationship in which the distance from the transport pole Z4 to an end of the suction duct 50 and the amount of dropped toner influence image quality defect is shown in FIG. 5. G0, G1.5, G2, G3, and G4 in the graph correspond to values that conceptually show the degrees of image quality defects, with the degrees of image quality defects increasing from G0 to G4. From FIG. 5, it is understood that, as the distance from the transport pole Z4 to the end of the suction duct 50 is increased, image quality defect resistance with respect to the amount of dropped toner is enhanced. Therefore, if toner cloud that is generated when the toner standing in the form of a chain falls is considered, as the distance of the end of the suction duct 50 from the transport Z4 is increased, the image quality defect resistance is enhanced.

As a result, the distance X is not set beyond the position where the toner T standing in the form of a chain falls at a downstream side from the center Z4-1 of the transport pole Z4 in the direction of rotation, that is, beyond the position where the toner cloud stands. This is because the generated toner cloud is transported by the developing roller 43*b* and is returned to the developer containing section 42*a* without being sucked by the suction duct 50.

The expression "is not set beyond the position where the toner cloud stands" refers to a range indicated by reference character Q on the horizontal axis in FIG. 4. When the range indicated by the reference character Q is prescribed, the aforementioned R+kRW (where k=10 to 12) is obtained. That is, in the exemplary embodiment, since, for example, R=0.0008 m and W=0.404 m/s, when 10 is substituted for the coefficient k in this formula, 3.0 mm is obtained (lower limit of the range indicated by the reference character Q); and, when 12 is substituted for the coefficient k, 3.5 mm is obtained (upper limit of the range indicated by the reference character Q).

Here, as in the exemplary embodiment, the behavior of dropped toner when the straight line L is positioned downstream of the center Z4-1 of the transport pole Z4 is shown in FIG. 6. The behavior of dropped toner when the straight line L is positioned upstream from the center Z4-1 of the transport pole Z4 is shown in FIG. 7.

As shown in FIG. 6, when the straight line L is situated downstream of the center Z4-1 of the transport pole Z4, the toner that has dropped from the suction duct 50 is taken into the developer before the toner stands in the form a chain at the development nip N. Therefore, the toner does not enter the development nip N. Instead, the toner is transported to the transport pole Z4 by the rotation of the developing roller 43*b*.

In contrast, as shown in FIG. 7, when the straight line L is situated upstream from the center Z4-1 of the transport pole Z4, the toner that has dropped from the suction duct 50 enters and passes the development nip N, thereby causing an image quality defect as that mentioned above to occur.

From this, it is necessary that the straight line L be situated downstream of the center Z4-1 of the transport pole Z4. As a result, when the distance from the center Z4-1 of the transport pole Z4 to the position where the straight line L crosses the sleeve 43*bb* is X (m), the chain standing length of the toner T on the transport pole Z4 is R(m), the peripheral velocity of the developing roller 43*b* is W(m/s), and the coefficient is k, the relationship $0 \leq X \leq R + kRW$ (where k=10 to 12) is established.

Therefore, while avoiding suction of the toner T scattered at the transport pole Z4 by the suction duct 50, defect in image quality caused by the toner T that has dropped from the suction duct 50 is avoided.

Although the invention carried out by the inventors is described in detail on the basis of an exemplary embodiment, the exemplary embodiment disclosed in the specification is an exemplification on all points, and should not to be thought of as limiting the disclosed technology. That is, the technical scope of the present invention is not to be construed in a limited sense on the basis of the explanation in the exemplary embodiment. The technical scope of the present invention should be strictly construed in accordance with the scope of the claims. Accordingly, technologies that are equivalent to the technology that is set forth in the scope of the claims and all modifications that do not depart from the gist of the scope of the claims are included.

For example, although, in the exemplary embodiment, the present invention is applied to a direct-transfer image forming apparatus that directly transfers a toner image on a photoconductor drum to a sheet, the present invention is not limited thereto. The invention is applicable to a second-transfer image forming apparatus that transfers a toner image transferred to an intermediate transfer belt (exemplary transfer medium) to a sheet.

Although, in the exemplary embodiment, the number of developing rollers disposed in a developing device is two, the present invention is not limited thereto. The number of developing rollers may be one or three or more.

Although, in the foregoing description, the present invention is applied to an image forming apparatus that records a color image as an image forming apparatus according to an exemplary embodiment, the present invention may be applied to an image forming apparatus that records a monochrome image.

What is claimed is:

1. An image forming apparatus comprising:

an image carrier on which an electrostatic latent image is formed;

a developing unit comprising a plurality of magnetic poles and a rotating section, the plurality of magnetic poles comprising: a development pole and a transport pole disposed along a peripheral direction, the rotating section being rotatably disposed at outer peripheries of the plurality of magnetic poles, the developing unit being disposed so as to oppose the image carrier, the developing unit configured to perform, at the development pole, development by supplying developer to the electrostatic latent image on the image carrier with a portion of the rotating section that opposes the image carrier rotating in a direction opposite to a direction of rotation of the image carrier; and a developer sucking section configured to open above the developing unit and configured to suck developer that is not used in the development, wherein a relationship $0 \leq X \leq R+kRW$ (where k=10 to 12) is established, when X (m) is a distance from a center of the transport pole to a position where a straight line crosses the rotating section, R(m) is a chain standing length of the developer on the transport pole, W(m/s) is a peripheral velocity of the developing unit, and k is a coefficient, the transport pole being adjacent to the development pole and being situated downstream of the development pole in the direction of rotation of the rotating section, the straight line being situated at a downstream side in the direction of rotation of the rotating section and connecting a center of rotation of the developing unit and an end of the developer sucking section.

2. An image forming apparatus comprising:

an image carrier means on which an electrostatic latent image is formed;

developing means including a plurality of magnetic poles and a rotating means, the plurality of magnetic poles including a development pole and a transport pole disposed along a peripheral direction, the rotating means being rotatably disposed at outer peripheries of the plurality of magnetic poles, the developing means being disposed so as to oppose the image carrier, the developing means for developing, at the development pole, by supplying developer to the electrostatic latent image on the image carrier with a portion of the rotating means that opposes the image carrier rotating in a direction opposite to a direction of rotation of the image carrier; and a developer sucking means configured to open above the developing means, the developer sucking means for sucking developer that is not used in the development, wherein a relationship $0 \leq X \leq R+kRW$ (where k=10 to 12) is established, when X (m) is a distance from a center of the transport pole to a position where a straight line crosses the rotating means, R(m) is a chain standing length of the developer on the transport pole, W(m/s) is a peripheral velocity of the developing means, and k is a coefficient, the transport pole being adjacent to the development pole and being situated downstream of the development pole in the direction of rotation of the rotating means, the straight line being situated at a downstream side in the direction of rotation of the rotating means and connecting a center of rotation of the developing means and an end of the developer sucking means.

* * * * *